United States Patent [19]

Tabuchi

[11] Patent Number: 4,952,982

[45] Date of Patent: Aug. 28, 1990

[54] COPYING APPARATUS AND METHOD

[75] Inventor: Shinichiro Tabuchi, Osaka, Japan

[73] Assignee: Minolta Camera Co., Ltd., Osaka, Japan

[21] Appl. No.: 329,449

[22] Filed: Mar. 28, 1989

[30] Foreign Application Priority Data

Mar. 30, 1988 [JP] Japan ..... 63-79846
Mar. 30, 1988 [JP] Japan ..... 63-79847

[51] Int. Cl.[5] ..... G03G 15/00
[52] U.S. Cl. ..... 355/316; 355/205; 355/206; 355/312; 355/315; 271/258
[58] Field of Search ..... 355/206, 205, 204, 203, 355/209, 316, 315, 317, 312, 309, 271, 274; 271/258, 110

[56] References Cited

U.S. PATENT DOCUMENTS 4,257,700 3/1981 Tsuda et al. ..... 355/315 X
4,391,439 7/1983 Edström ..... 271/90
4,713,674 12/1987 Giezeman et al. ..... 355/316
4,745,435 5/1988 Sakata et al. ..... 355/316
4,825,248 4/1989 Honjo et al. ..... 355/316 X

FOREIGN PATENT DOCUMENTS 62-102265 5/1987 Japan .

*Primary Examiner*—A. C. Prescott
*Attorney, Agent, or Firm*—Willian Brinks Olds Hofer Gilson & Lione

[57] ABSTRACT

A copying apparatus and method is disclosed. Provided as main parts are detection means for detecting the separation condition of the recording paper and control means for controlling at least one of charging means, separation means, and transport means in accordance with the detection result.

20 Claims, 6 Drawing Sheets

COPYING APPARATUS AND METHOD

BACKGROUND OF THE INVENTION (1) Field of the Invention

The present invention refers to a copying apparatus and method which is effective when employed in image forming apparatus utilizing the xerographic process.

(2) Description of the Related Art

A conventional xerographic image forming apparatus functions as follows. Charged powdered toner is adhered on a photoconductive layer on the surface of an image carrier which runs endlessly, whereby a transferable toner image is formed on the image carrier. A recording medium, mainly paper, is contacted on the toner image and is given the opposite charge from that of the toner. In this way, the toner image is transferred on the recording medium. The recording medium is separated from the image carrier, and then the toner is fixed on the recording medium. The residual toner and the residual charge on the image carrier are removed. The above process is repeated.

In such a xerographic image forming apparatus, the recording medium remains on the image carrier by static electricity even after image transference. In order to easily separate the recording medium from the image carrier, an AC corona is applied on the recording medium after transference. In this way, the recording medium is given the opposite charge from what was given before transference, and as a result is neutralized. This neutralization promotes good separation of the recording medium from the image carrier. The firmness and elasticity of the recording medium itself also promote good separation. A copying apparatus having the above construction is widely used.

However, paper, which is most widely used as the recording medium, greatly varies in its elasticity and firmness depending on the kind, usage environment, and especially humidity. Therefore, the above separation method cannot necessarily provide constant level of separation.

Further, the above separation method has the following problem. As the total number of copies is increased, toner splashing, paper powder generated by the recording medium, and other foreign substances are adhered on the charging wire of the charger, resulting in decrease or unstableness of discharged current. This means the separation condition deteriorates.

SUMMARY OF THE INVENTION

This invention has an object of providing a copying apparatus and method to maintain the good separation condition irrespective of the kind of the paper and the usage environment.

Another object of this invention is to provide a copying apparatus and method to accurately detect the separation condition.

The above objects are fulfilled by a copying apparatus comprising a photosensitive member; charging means for applying electric charge to the photosensitive member; exposure means for exposing the photosensitive member to form an electrostatic latent image corresponding to a document on the photosensitive member; developing means for developing the electrostatic latent image by adhering toner thereon to form a toner image; recording medium feeding means for feeding a recording medium on which the toner image is to be transferred; transfer means for transferring the toner image on the recording medium; separation means for separating the recording medium from the photosensitive member after image transference; transport means for transporting the separated recording medium; detection means for detecting the separated recording medium; discrimination means for discriminating the separation condition of the recording medium as one of multiple states in accordance with the detection result; and control means for controlling at least one of the charging means, the separation means and the transport means in accordance with the discrimination result.

The above objects are also fulfilled by a copying method in a copying apparatus comprising a photosensitive member; charging means for applying electric charge to the photosensitive member; exposure means for exposing the photosensitive member to form an electrostatic latent image corresponding to a document on the photosensitive member; developing means for developing the electrostatic latent image by adhering toner thereon to form a toner image; recording medium feeding means for feeding a recording medium on which the toner image is to be transferred; transfer means for transferring the toner image on the recording medium; separation means for separating the recording medium from the photosensitive member after image transference; transport means for transporting the separated recording medium; and detection means for detecting the separated recording medium; the method comprising the steps of: detecting the separated recording medium, discriminating the separation condition of the recording medium as one of multiple states in accordance with the detection result, and controlling at least one of the charging means, the separation means and the transport means in accordance with the discrimination result.

The above objects are also fulfilled by a copying apparatus comprising a photosensitive member; image forming means for forming an image on the photosensitive member; recording medium feeding means for feeding a recording medium on which the image is to be transferred; transfer means for transferring the image on the photosensitive member onto the recording medium; separation means for separating the recording medium from the photosensitive member after image transference; transport means for transporting the separated recording medium, having a belt and suction means for adhering the recording medium on the belt; detection means for detecting the separation condition of the recording medium; and control means for controlling the suction power of the suction means in accordance with the detection result.

The above objects are also fulfilled by a copying method in a copying apparatus comprising a photosensitive member; image forming means for forming an image on the photosensitive member; recording medium feeding means for feeding a recording medium on which the image is to be transferred; transfer means for transferring the image on the photosensitive member onto the recording medium; separation means for separating the recording medium from the photosensitive member after image transference; transport means for transporting the separated recording medium, having a belt and suction means for adhering the recording medium on the belt; and detection means for detecting the separated recording medium; the method comprising the steps of: discriminating the separation condition of the recording medium as one of multiple states in accordance with the detection result, and controlling the suction power of the suction means in accordance with the discrimination result.

The above objects are also fulfilled by a copying apparatus comprising a photosensitive member; image forming means for forming an image on the photosensitive member; recording medium feeding means for feeding a recording medium on which the image is to be transferred; transfer means for transferring the image on the photosensitive member onto the recording medium; main separation means for separating the recording medium from the photosensitive member after image transference; sub separation means for separating the recording medium from the photosensitive member after image transference; detection means for detecting the separation condition of the recording medium; and control means for continuously driving the main separation means and for driving the sub separation means in accordance with the separation condition.

The above objects are also fulfilled by a copying apparatus comprising a photosensitive member; charging means for applying electric charge to the photosensitive member; exposure means for exposing the photosensitive member to form an electrostatic latent image corresponding to a document on the photosensitive member; developing means for developing the electrostatic latent image by adhering toner thereon to form a toner image; recording medium feeding means for feeding a recording medium on which the toner image is to be transferred; transfer means for transferring the toner image on the recording medium; separation means for separating the recording medium from the photosensitive member after image transference; detection means for detecting the separation condition of the recording medium; and control means for controlling the charging means in accordance with the detection result.

The above objects are also fulfilled by a copying method in a copying apparatus comprising a photosensitive member; charging means for applying electric charge to the photosensitive member; exposure means for exposing the photosensitive member to form an electrostatic latent image corresponding to a document on the photosensitive member; developing means for developing the electrostatic latent image by adhering toner thereon to form a toner image; recording medium feeding means for feeding a recording medium on which the toner image is to be transferred; transfer means for transferring the toner image on the recording medium; separation means for separating the recording medium from the photosensitive member after image transference; and detection means for detecting the separated recording medium; the method comprising the steps of: discriminating the separation condition of the recording medium as one of multiple states in accordance with the detection result, and controlling the power of the charging means in accordance with the discrimination result.

The above objects are fulfilled by a copying apparatus comprising a photosensitive member; image forming means for forming an image on the photosensitive member; recording medium feeding means for feeding a recording medium on which the image is to be transferred; transfer means for transferring the image on the photosensitive member onto the recording medium; separation means for separating the recording medium from the photosensitive member after image transference; detection means for detecting the separated recording medium; discrimination means for discriminating the separation condition of the recording medium as one of multiple states in accordance with the detection result; and warning means for warning that the separation condition is abnormal.

The above objects are also fulfilled by a copying method in a copying apparatus comprising a photosensitive member; image forming means for forming an image on the photosensitive member; recording medium feeding means for feeding a recording medium on which the image is to be transferred; transfer means for transferring the image on the photosensitive member onto the recording medium; separation means for separating the recording medium from the photosensitive member after image transference; and detection means for detecting the separated recording medium; the method comprising the steps of: discriminating the separation condition of the recording medium as one of multiple states in accordance with the detection result, and warning that the separation condition is abnormal.

The charging means may comprise a corona discharging device and the control means may control the power of the corona discharging device.

The separation means may comprise a corona discharging device and the control means may control the power of the corona discharging device.

The separation means may comprise a separating member which is freely contacted on or separated from the photosensitive body, and the control means may control the contact and separation of the separating member.

The transport means may comprise a belt and a suction means to adhere the recording medium on the belt, and the control means may control the suction power of the suction means.

The detection means may be provided between the separation means and the transport means and detects the recording medium making an abnormal movement between the separation means and the transport means.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF A PREFERRED EMBODIMENT

Figure 1:
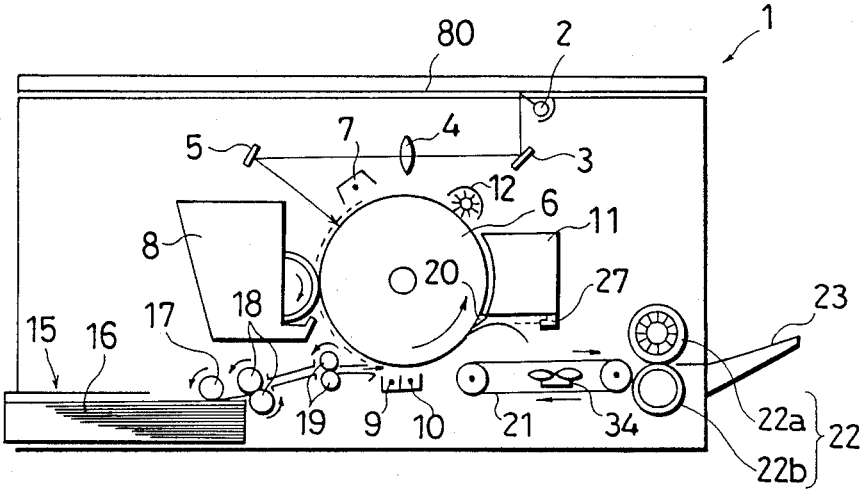
FIG. 1 shows an internal construction of a copier 1 in a simplified form, FIG. 2 explains ill separation of a recording paper 16.

FIG. 1 shows an internal construction of an embodiment of this invention in a simplified form. A copier 1 has a transparent document table 80 on its upper surface and a light source 2 below the document table 80. The light emitted from the light source 2 is irradiated on a document through the document table 80. Then, the light is scattered on the document, reflected on a reflecting mirror 3, transmitted through a lens 4, reflected on another reflecting mirror 5, and then slit-exposed on the surface of a photoconductive drum 6. Provided around the photoconductive drum 6 are a main charger 7, a developing device 8, a transfer charger 9, a separation charger 10, a cleaner 11 and an erasing lamp 12. They are arranged in this order in the rotating direction of the photoconductive drum 6. Prior to the above slit-exposure, the surface of the photoconductive drum 6 is charged by the main charger 7, whereby the photoconductive drum 6 is driven to rotate in the direction of the arrow and exposed in the exposing region to have an electrostatic latent image corresponding to the document formed on the surface thereof. The photoconductive drum 6 is further rotated until the electrostatic latent image faces the developing device 8. Then, the developing device 8 adheres toner on the surface of the photoconductive drum 6 using static electricity, so as to form a toner image corresponding to the electrostatic latent image on the surface of the photoconductive drum 6. The main charger 7, the transfer charger 9, and the separation charger 10 are corona discharging devices.

A recording paper 16 in a feeding cassette 15 is fed by a feeding roller 17 and passes between a pair of transport rollers 18 until its leading end is stopped by a pair of register rollers 19. Timed with the rotation of the photoconductive drum 6, the recording paper 16 is supplied between the transfer charger 9 and the photoconductive drum 6 and is contacted on the toner image formed on the surface of the photoconductive drum 6. Here, the transfer charger 9 provides the back of the recording paper 16 with the opposite charge from that of the toner, whereby the toner image on the photoconductive drum 6 is transferred on the recording paper 16.

In the above procedure, the recording paper 16 is adhered on the surface of the photoconductive drum 6 by static electricity. In order to separate the recording paper 16 from the photoconductive drum 6, the separation charger 10 should provide the recording paper 16 with the opposite charge from what the transfer charger 9 did, for the purpose of neutralization. Also, the firmness of the recording paper 16 itself and a separation pallet 20 promote the separation. Then, the recording paper 16 is transported by an endless transport belt 21, has the image fixed by a heat fixing device 22 formed of a pair of rollers 22*a* and 22*b*, and is delivered onto a delivery tray 23. The residual toner on the photoconductive drum 6 is scratched off by the cleaner 11 and erased by the erasing lamp 12.

Figure 2:
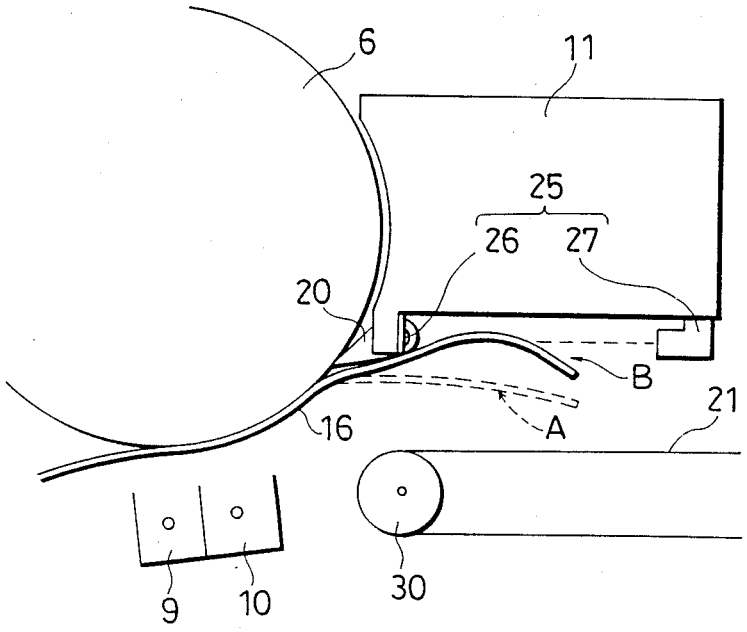

As shown in FIG. 2, detection means 25 is provided below the cleaner 11 to detect the separation condition of the recording paper 16. The detecting means 25 comprises a reflecting mirror 26 and a reflecting optical sensor 27. The reflecting mirror 26 is provided close to the photoconductive drum 6 and the reflecting optical sensor 27 a farther from the reflecting mirror 26. When the separation does not go well, the recording paper 16 is transported as shown with a solid line B, that is, it is dragged by the photoconductive drum 6 a little away from the normal pass shown with a dashed line A. When the separation goes well, the light from light emitting elements of the optical sensor 27 is reflected on the reflecting mirror 26 and received by light receiving elements of the optical sensor 27. On the other hand, when the recording paper 16 runs as B, the light from the optical sensor 27 is cut off, and the light receiving elements of the optical sensor 27 do not receive the light. The detection means 25 detects the separation condition of the recording paper 16 using the above theory.

Figure 3:
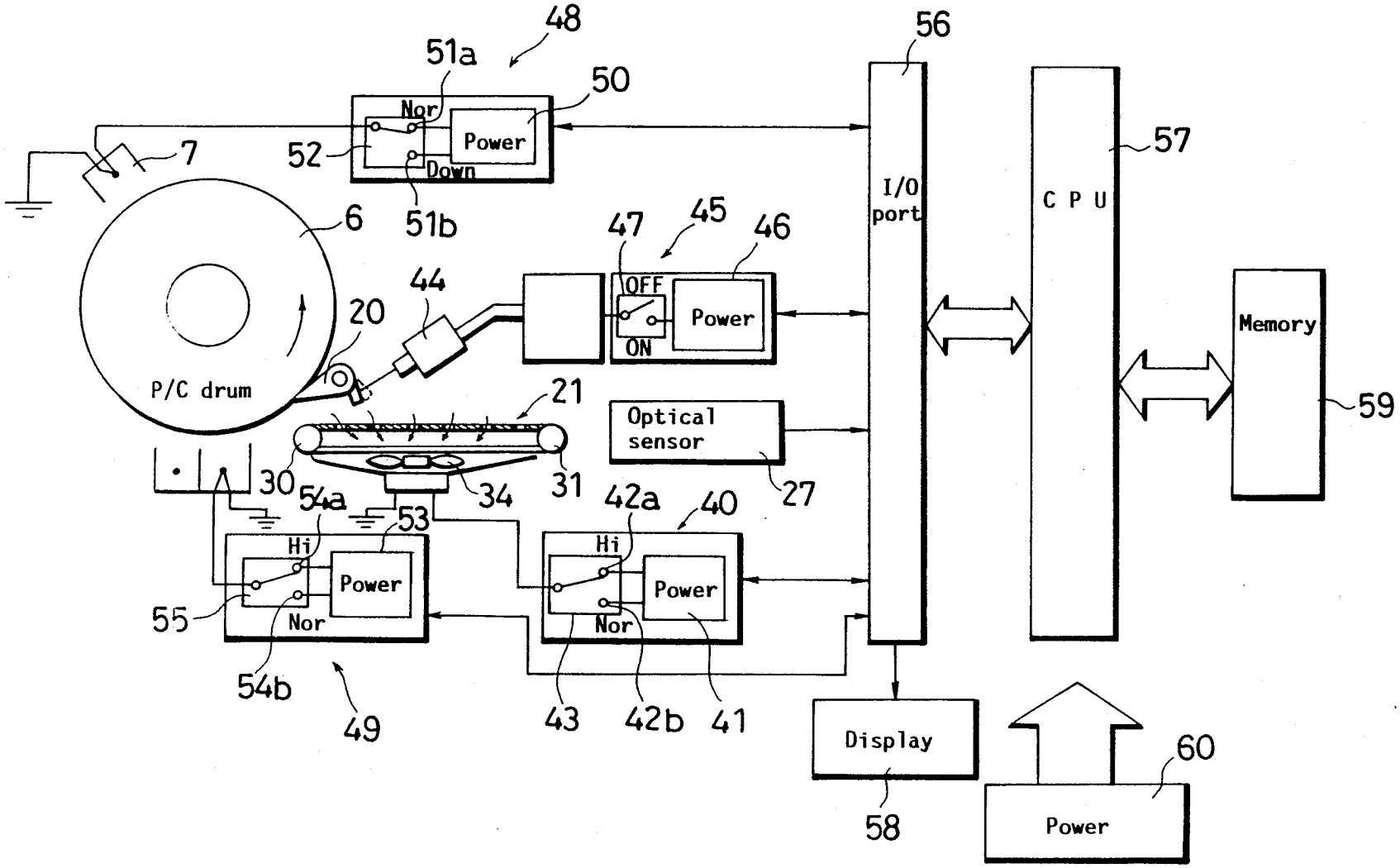
FIG. 3 is a block diagram concerning the separation control.

FIG. 3 shows an electric construction concerning the separation. The endless transport belt 21, which is travelling between pulleys 30 and 31, has multiple suction holes (not shown) on the transport surface thereof. A suction fan 34 is provided below the suction holes. Air is drawn in the direction of the arrows by the suction fan 34 and exhausted through an exhaust duct (not shown). The recording paper 16 is adhered well on the transport surface of the transport belt 21 by the above air flow and is supplied between the rollers 22*a* and 22*b*.

The suction fan 34 is driven by a suction fan driving circuit 40. The suction fan driving circuit 40 comprises a power source 41 and a switching circuit 43 for selecting the high output terminal 42*a* or the normal output terminal 42*b*.

The separation pallet 20 is driven to go away from the photoconductive drum 6 by an electromagnetic solenoid 44, which is driven by a solenoid driving circuit 45. The solenoid driving circuit 45 comprises a power source 46 and a switching circuit 47 for turning on or off the power from the power source 46.

The main charger 7 has a main charger transformer circuit 48, and the separation charger 10 has a separation charger transformer circuit 49. The main charger transformer circuit 48 has a power source 50 and a switching circuit 52 for selecting the normal output terminal 51*a* or the down output terminal 51*b*. The separation charger transformer circuit 49 has a power source 53 and a switching circuit 55 for selecting the high output terminal 54*a* and the normal output terminal 54*b*. The main charger transformer circuit 48, the solenoid driving circuit 45, the suction fan driving circuit 40, the optical sensor 27 and separation charger transformer circuit 49 are connected to a central processing unit (referred to as CPU hereinafter) 57 through an I/O port 56. The CPU 57 outputs switching control signals to the above-mentioned switching circuits 43, 47, 52 and 55 for separation control. In accordance with the above signals, the switching circuits 43, 47, 52 and 55 are switched over. A display section 58, including an LED for displaying the separation condition, is also connected to the CPU 57 through the I/O port 56. The CPU 57 is connected with a non-volatile memory 59, which stores constants such as the predetermined separation indexes Ri (i=0 to 4) and the system program. A power source 60 is a commercially available alternating power source. The above power sources 41, 46, 50 and 53 were obtained by transforming the voltage of the power source 60. The above separation control, separation condition and separation indexes will be detailed later.

The CPU 57 calculates the ratio of ill separation C against the total number of copies N, that is, R=C/N based on the detection result sent from the optical sensor 27. Then, it compares R and the separation index Ri (i=0 to 4), and classifies the separation condition as one of the five states in accordance with the comparison result. The five states will be explained later.

The followings are the methods to restore good separation: changing the output of the separation charger 10, pressure-contacting the separation pallet 20 on the photoconductive drum 6, changing the suction power of the suction fan 34, and changing the output of the main charger 7.

If the output of the separation charger 10 is increased, the neutralization of the recording paper 16 is promoted, whereby good separation is restored.

Pressure-contacting the separation pallet 20 on the photoconductive drum 6 prevents the recording paper 16 from being dragged a little by the photoconductive drum 6, so as to restore good separation.

Increasing the suction power of the suction fan 34 restores good separation as described below. When the separation condition deteriorates, the recording paper 16 is dragged by the photoconductive drum 6 and separated a little later than in the normal state. In consequence, the distance between the separating point and the transport belt 21 is a little longer, which means the recording paper 16 contacts the transport belt 21 at a point closer to the pulley 31 than in the normal state. As a result, the recording paper 16 is adhered on the transport belt 21 with smaller suction power. If the recording paper 16 is supplied between the rollers **22*a* and 22*b* with such a weak adherence on the transport belt 21, the recording paper 16 may be jammed, shrinked or folded at its end. However, if the suction power of the suction fan 34 is increased, the adherence of the recording paper 16 on the transport belt 21** is strong enough to avoid jamming or shrinkage.

When the output of the main charger 7 is decreased, the electrostatic adherence of the recording paper 16 on the photoconductive drum 6 is weakened, and thus good separation is restored.

Table 1 shows how to combine the above four methods. Either one of the two driving modes of the main charger 7, the separation charger 10, the separation pallet 6 and the suction fan 34 are combined to normalize the separation classified as one of the five states 0 to 4.

TABLE 1

| Separation state | 0 | 1 | 2 | 3 | 4 |
|---|---|---|---|---|---|
| Separation charger output | Nor | Nor | Hi | Hi | Hi |
| Separation pallet contact | OFF | ON | ON | ON | ON |
| Suction fan power | Nor | Nor | Nor | Hi | Hi |
| Main charger output | Nor | Nor | Nor | Nor | Down |

Nor: Normal

Figure 4:
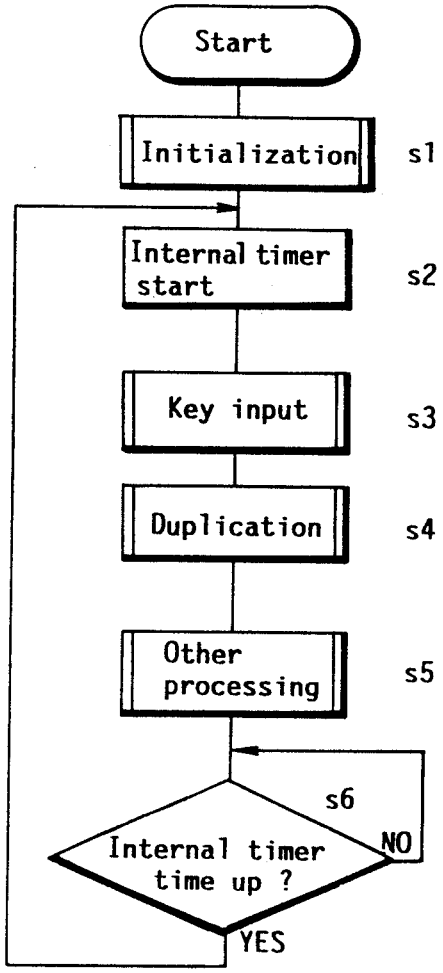
FIG. 4 is a flow chart showing the overall operation of the copier 1.

FIG. 4 is a flow chart showing the overall operation routine of the copier 1. The routine is initialized in s1, the timer starts operating in s2, and the key input is responded in s3. The duplication operation in s4 will be detailed in FIG. 5. Other precessing is done in s5 and an internal timer is judged in Step s6. If the time is up, the operation goes back to s2.

Figure 5:
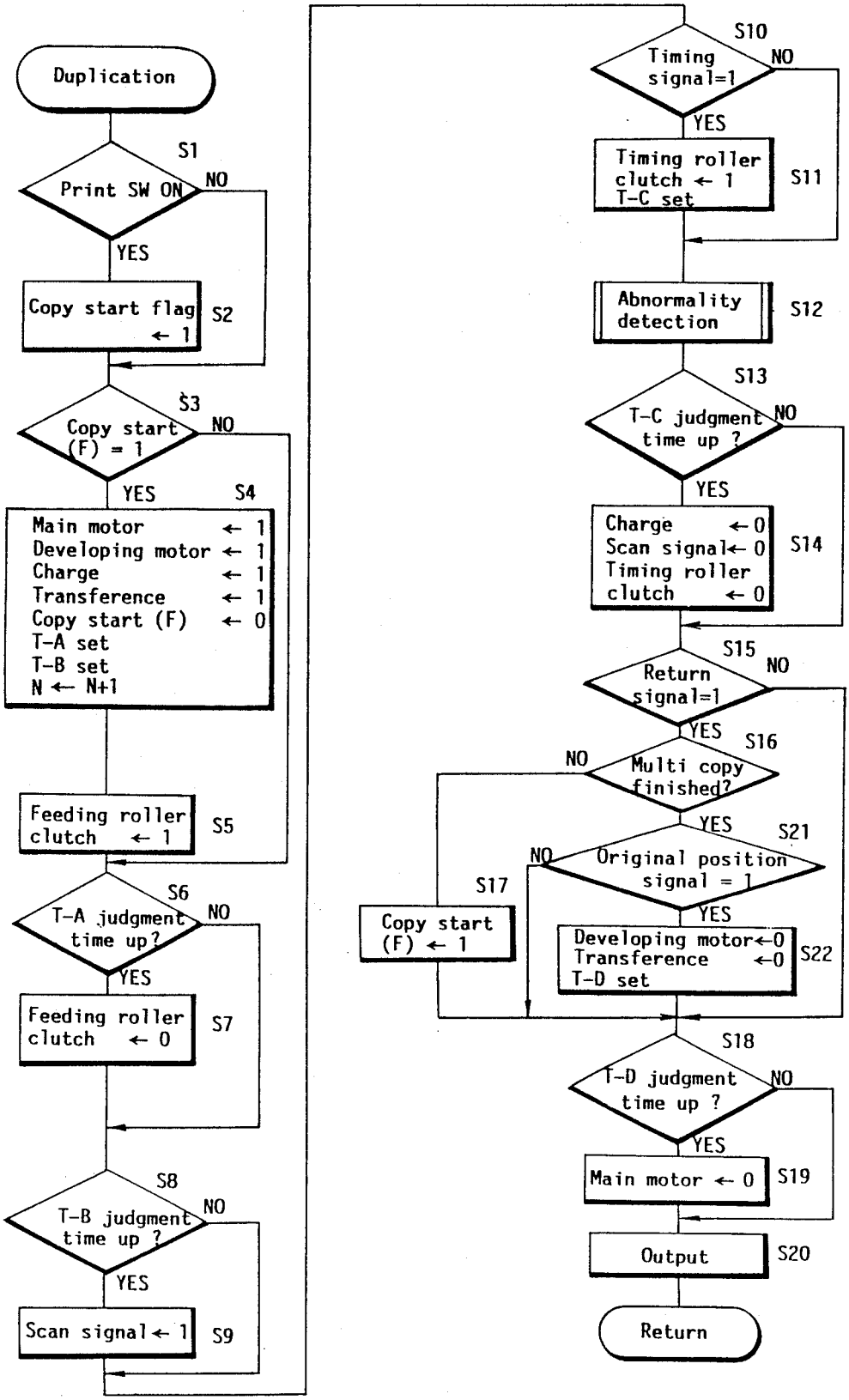
FIG. 5 is a flow chart showing the duplication subroutine.

FIG. 5 indicates the subroutine of the duplication operation.

When the print switch is turned on in S1, the copy start flag is set at 1 (S2). Whether the copy start flag is 1 or not is judged in S3, and if so, the operation advances to S4. In S4, a main motor, a developing motor, the main charger 7 and the transfer charger 9 are turned on ("1" means ON), the copy start flag is reset at 0, and timers A and B (T-A, T-B) are set. Also, the number of copies N is incremented by 1. A feeding roller clutch is turned on to feed the recording paper 16 in S5. The timer A is judged in S6, and if the time is up, the feeding roller clutch, which has been turned on, is turned off in S7. The timer B is judged in S8, and if the time is up, a scan signal is turned on in S9. When a timing signal is 1 in S10, a timing roller clutch is turned on and a timer C is set in S11. When the timing roller clutch is turned on, the timing roller is driven, whereby the recording paper 16 is timed with the rotation of the photoconductive drum 6 and has the toner image transferred on itself. After the recording paper 16 is separated from the photoconductive drum 6, it is supplied between the rollers **22*a* and 22*b***.

Figure 6:
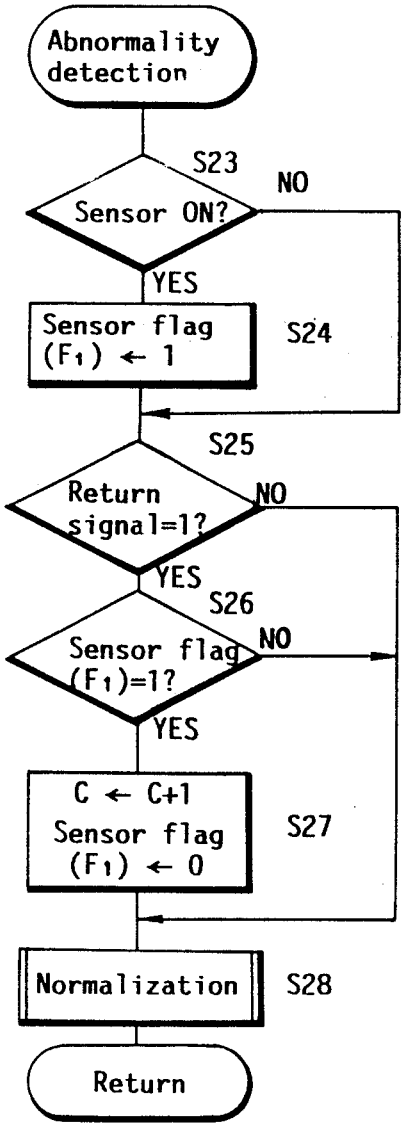
FIG. 6 is a flow chart showing the abnormality detection subroutine.

The abnormality detection routine in S12 will be detailed in FIG. 6. The timer C is judged in S13, and if the time is up, the main charger 7, the scan signal and the timing roller clutch are turned off in S14. If a return signal is 1 in S15, namely, if a scanner starts returning, the operation goes to S16. In S 16, whether the commanded number of copies, are completed or not is judged. If they have not been completed, the copy start flag is set at 1 in S17, and the results of the processing so far done are output in S20. After that, the above duplication operation is repeated. If the commanded number of copies are completed, the operation goes from S16 to S21. When the scanner goes back to its original position and turns on an original position switch in S21, the developing motor and the transfer charger 9 are turned off and the timer D is set (S22). If the time of the timer D is up in S18, the main motor is turned off (S19) and the final result is output (S20).

FIG. 6 shows the abnormality detection subroutine. Whether the optical sensor 27 outputs a detection signal or not is judged in S23, and if not, the operation advances to S25. If the detection signal is output in S23, the sensor flag is set at 1 (S24). Whether the return signal is 1 or not is judged in S25, and if not, the operation goes to S28. If so, the operation goes to S26. In S26, whether the sensor flag is 1 or not is judged. If not, the operation goes to S28. If so, the number of detected ill separation C is incremented by 1 and the sensor flag is reset at 0 in S27. Then, the operation goes to S28, where the normalization routine detailed in FIG. 7 is executed.

Figure 7:
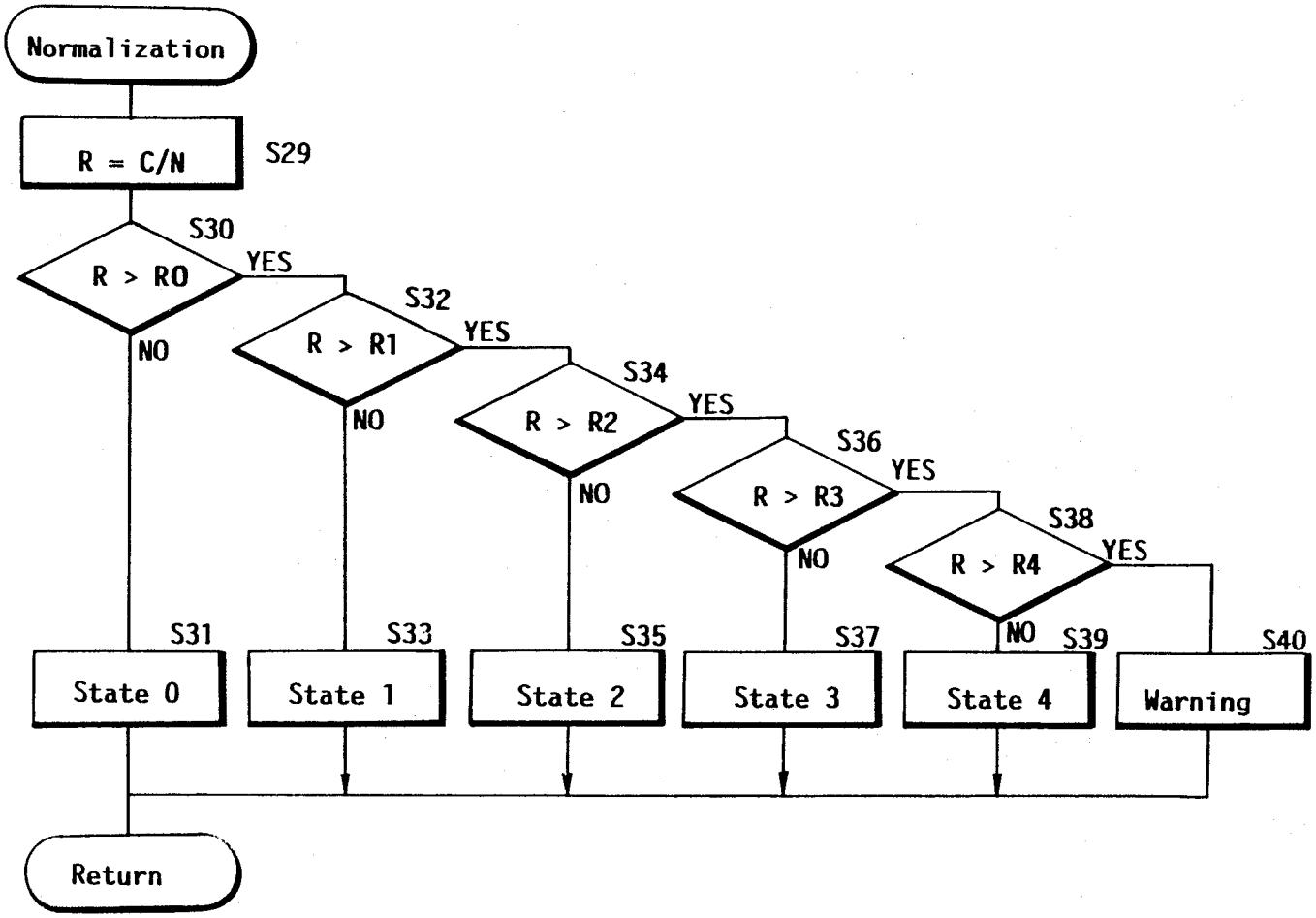
FIG. 7 is a flow chart showing the normalization subroutine.

FIG. 7 shows the normalization subroutine. In S29 the ratio of the number of detected ill separation C against the total number of copies N, that is, $R=C/N$ is calculated. In S30, whether R is more than R0 (the separation index of State 0) or not is judged. If not, the separation condition is judged good and classified as State 0. In this case, the output of the separation charger 10 is normal, the separation pallet 20 is separated from the photoconductive drum 6, the suction power of the suction fan 34 is normal, and the output of the main charger 7 is normal.

When R is more than R0 in S30, the operation goes to S32, where whether R is more than R1 (the separation index of State 1) or not is judged. If not, the operation goes to S33, where the separation condition is classified as State 1 and normalized by the following combination: the outputs of the separation charger 10 and the main charger 7 and the suction power of the suction fan 34 are normal, but the separation pallet 20 is pressure-contacted on the photoconductive drum 6.

When R is more than R1 in S32, the operation goes to S34, where whether R is more than R2 (the separation index of State 2) or not is judged. If not, the operation goes to S35, where the separation condition is classified as State 2 and normalized by the following combination: the separation pallet 20, the suction fan 34, and the main charger 7 are the same as in State 1, but the separation charger 10 outputs more power.

When R is more than R2 in S34, the operation goes to S36, where whether R is more than R3 (the separation index of State 3) or not is judged. If not, the operation goes to S37, where the separation condition is classified as State 3 and normalized by the following combination: the separation charger 10, the separation pallet 20 and the main charger 7 are the same as in State 2, but the suction fan 34 absorbs with more power.

When R is more than R3 in S36, the operation goes to S38, where whether R is more than R4 (the separation index of State 4) or not is judged. If not, the operation goes to S39, where the separation condition is classified as State 4 and normalized by the following combination: the separation charger 10, the separation pallet 20 and the suction fan 34 are the same as in State 3, but the main charger 7 outputs less power.

In this way, the separation condition is classified as either one of the five states by comparing R and the index R0 to R4. This system maintains good separation and also selects the normalization method with smallest possible side effects. A copier with good separation and best possible image quality is thus obtained.

If R is more than R4 in S38, the operation goes to S40, where warning is displayed to inform the user of the necessity of maintenance such as cleaning of the separation charger 10.

In the above embodiment, the detection means 25 is formed of the reflecting mirror 26 and the optical sensor 27. However, such mechanical switches as a limit switch, or infrared sensor, ultrasonic sensor, etc. may be employed.

The above embodiment classifies the separation condition into five states and normalized by switching the driving modes of four constructing members: the separation charger 10, the separation pallet 20, the suction fan 34 and the main charger 7. However, other members can also be used to classify the separation condition into more states.

Although the present invention has been fully described by way of an embodiment with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus comprising:

a photosensitive member, charging means for applying electric charge to said photosensitive member, exposure means for exposing said photosensitive member to form an electrostatic latent image corresponding to a document on said photosensitive member, developing means for developing the electrostatic latent image by adhering toner thereon to form a toner image, recording medium feeding means for feeding a recording medium on which the toner image is to be transferred, transfer means for transferring the toner image on the recording medium, separation means for separating the recording medium from said photosensitive member after image transference, transport means for transporting the separated recording medium, detection means for detecting the separated recording medium, discrimination means for discriminating the separation condition of the recording medium as one of multiple states in accordance with the detection result, and control means for controlling at least one of said charging means, said separation means and said transport means in accordance with the discrimination result.

2. A copying apparatus claimed in claim 1, wherein said charging means comprises a corona discharging device and wherein said control means controls the power of the corona discharging device.

3. A copying apparatus claimed in claim 1, wherein said separation means comprises a corona discharging device and wherein said control means controls the power of the corona discharging device.

4. A copying apparatus claimed in claim 1, wherein said separation means comprises a separating member which is freely contacted on or separated from said photosensitive member, and wherein said control means controls the contact and separation of the separating member.

5. A copying apparatus claimed in claim 1, wherein said transport means comprises a belt and a suction means for adhering the recording medium on the belt, and wherein said control means controls the suction power of the suction means.

6. A copying apparatus claimed in claim 1, wherein said detection means is provided between said separation means and said transport means and detects the recording medium making an abnormal movement between said separation means and said transport means.

7. A copying apparatus claimed in claim 6, wherein said discrimination means discriminates the separation condition as one of the multiple states in accordance with the ratio of abnormal separation against the total number of copies.

8. A copying method in a copying apparatus comprising a photosensitive member; charging means for applying electric charge to said photosensitive member; exposure means for exposing said photosensitive member to form an electrostatic latent image corresponding to a document on said photosensitive member; developing means for developing the electrostatic latent image by adhering toner thereon to form a toner image; recording medium feeding means for feeding a recording medium on which the toner image is to be transferred; transfer means for transferring the toner image on the recording medium; separation means for separating the recording medium from said photosensitive member after image transference; transport means for transporting the separated recording medium; and detection means for detecting the separated recording medium; the method comprising the steps of: detecting the separated recording medium, discriminating the separation condition of the recording medium as one of multiple states in accordance with the detection result, and controlling at least one of said charging means, said separation means and said transport means in accordance with the discrimination result.

9. A copying apparatus comprising:

a photosensitive member, image forming means for forming an image on said photosensitive member, recording medium feeding means for feeding a recording medium on which the image is to be transferred, transfer means for transferring the image on said photosensitive member onto the recording medium, separation means for separating the recording medium from said photosensitive member after image transference, transport means for transporting the separated recording medium, having a belt and suction means for adhering the recording medium on the belt, detection means for detecting the separation condition of the recording medium, and control means for controlling the suction power of the suction means in accordance with the detection result.

10. A copying apparatus claimed in claim 9, wherein said detection means is provided between said separation means and said transport means and detects the recording medium making an abnormal movement between said separation means and said transport means.

11. A copying apparatus claimed in claim 10, wherein said control means controls the suction power of the suction means when the ratio of abnormal separation against the total number of copies reaches a predetermined level.

12. A copying method in a copying apparatus comprising a photosensitive member; image forming means for forming an image on said photosensitive member; recording medium feeding means for feeding a recording medium on which the image is to be transferred; transfer means for transferring the image on said photosensitive member onto the recording medium; separation means for separating the recording medium from said photosensitive member after image transference; transport means for transporting the separated recording medium, having a belt and suction means for adhering the recording medium on the belt; and detection means for, detecting the separated recording medium; the method comprising the steps of: discriminating the separation condition of the recording medium as one of multiple states in accordance with the detection result, and controlling the suction power of the suction means in accordance with the discrimination result.

13. A copying apparatus comprising:

a photosensitive member, image forming means for forming an image on said photosensitive member, recording medium feeding means for feeding a recording medium on which the image is to be transferred, transfer means for transferring the image on said photosensitive member onto the recording medium, main separation means for separating the recording medium from said photosensitive member after image transference, sub separation means for separating the recording medium from said photosensitive member after image transference, detection means for detecting the separation condition of the recording medium, and control means for continuously driving said main separation means and for driving said sub separation means in accordance with the separation condition.

14. A copying apparatus claimed in claim 13, wherein said main separation means is a corona discharging device.

15. A copying apparatus claimed in claim 13, wherein said sub separation means is a separating member which is freely contacted on or separated from said photosensitive member.

16. A copying apparatus comprising:

a photosensitive member, charging means for applying electric charge to said photosensitive member, exposure means for exposing said photosensitive member to form an electrostatic latent image corresponding to a document on said photosensitive member, developing means for developing the electrostatic latent image by adhering toner thereon to form a toner image, recording medium feeding means for feeding a recording medium on which the toner image is to be transferred, transfer means for transferring the toner image on the recording medium, separation means for separating the recording medium from said photosensitive member after image transference, detection means for detecting the separation condition of the recording medium, and control means for controlling said charging means in accordance with the detection result.

17. A copying apparatus claimed in claim 16, wherein said charging means comprises a corona discharging device and wherein said control means controls the power of the corona discharging device in accordance with the detection result.

18. A copying method in a copying apparatus comprising a photosensitive member; charging means for applying electric charge to said photosensitive member; exposure means for exposing said photosensitive member to form an electrostatic latent image corresponding to a document on said photosensitive member; developing means for developing the electrostatic latent image by adhering toner thereon to form a toner image; recording medium feeding means for feeding a recording medium on which the toner image is to be transferred; transfer means for transferring the toner image on the recording medium; separation means for separating the recording medium from said photosensitive member after image transference; and detection means for detecting the separated recording medium; the method comprising the steps of: discriminating the separation condition of the recording medium as one of multiple states in accordance with the detection result, and controlling the power of said charging means in accordance with the discrimination result.

19. A copying apparatus comprising:

a photosensitive member, image forming means for forming an image on said photosensitive member, recording medium feeding means for feeding a recording medium on which the image is to be transferred, transfer means for transferring the image on said photosensitive member onto the recording medium, separation means for separating the recording medium from said photosensitive member after image transference, detection means for detecting the separated recording medium, discrimination means for discriminating the separation condition of the recording medium as one of multiple states in accordance with the detection result, and warning means for warning that the separation condition is abnormal.

20. A copying method in a copying apparatus comprising a photosensitive member; image forming means for forming an image on said photosensitive member; recording medium feeding means for feeding a recording medium on which the image is to be transferred; transfer means for transferring the image on said photosensitive member onto the recording medium; separation means for separating the recording medium from said photosensitive member after image transference; and detection means for detecting the separated recording medium; the method comprising the steps of: discriminating the separation condition of the recording medium as one of multiple states in accordance with the detection result, and warning that the separation condition is abnormal.

* * * * *